US005510967A

United States Patent [19]

Coushaine et al.

[11] Patent Number: 5,510,967

[45] Date of Patent: Apr. 23, 1996

[54] HID HEADLAMP ASSEMBLY

[75] Inventors: Charles M. Coushaine, Rindge, N.H.; Peter H. Corsini, Sandwich, Mass.; John L. Tremblay, Hopkinton, N.H.

[73] Assignee: Osram Sylvania Inc., Danvers, Mass.

[21] Appl. No.: 354,508

[22] Filed: Dec. 13, 1994

[51] Int. Cl.[6] ..... F21V 21/24

[52] U.S. Cl. ..... 362/261; 362/287

[58] Field of Search ..... 362/261, 226, 362/287

[56] References Cited

U.S. PATENT DOCUMENTS

| | | | |
|---|---|---|---|
| 4,357,651 | 11/1982 | Mayer | 382/287 |
| 4,734,612 | 3/1988 | Sasaki et al. | 313/15 |
| 4,754,373 | 6/1988 | Otto et al. | 362/61 |
| 5,029,058 | 7/1991 | Hirose et al. | 362/287 |
| 5,032,758 | 7/1991 | Davenport et al. | 313/113 |
| 5,036,439 | 7/1991 | Hoffmann et al. | 362/61 |
| 5,039,904 | 8/1991 | Kosmataka et al. | 131/318 |
| 5,051,658 | 9/1991 | Van Pijkeren | 315/82 |
| 5,059,855 | 10/1991 | Irisawa et al. | 313/318 |
| 5,216,318 | 6/1993 | Van Dulinen et al. | 362/226 |
| 5,291,092 | 3/1994 | Coushaine | 313/318 |
| 5,377,087 | 12/1994 | Yoon | 362/287 |
| 5,386,173 | 1/1995 | Kosmatka | 362/226 |
| 5,404,297 | 4/1995 | Birk et al. | 362/287 |

*Primary Examiner*—Denise L. Gromada
*Assistant Examiner*—Alfred Basichas
*Attorney, Agent, or Firm*—William E. Meyer

[57] ABSTRACT

An arc discharge lamp having the ability to be easily focused is disclosed. The lamp includes a split ball assembly mounted about one end of an arc discharge tube which can be held in place by concave portions provided in a base and a locking nut. The split ball assembly also includes a rotation limiting portion to provide the ramp with a limited degree of movement in two axes. Additionally, the split ball assembly allows the lamp to be moved in a third axis. The resulting movement of the lamp allows it to be properly focused with any reflector.

17 Claims, 12 Drawing Sheets

HID HEADLAMP ASSEMBLY

FIELD OF THE INVENTION

The invention relates to electric lamps such as small volume arc discharge lamps. More particularly, the invention is concerned with a support structure for small volume arc discharge lamps used in automobiles and other vehicles.

BACKGROUND OF THE INVENTION

Small volume arc discharge lamps are currently being developed for use as vehicle headlamps. These lamps offer long service lives and have a high electrical efficiency. In addition, such lamps have small optical sources and thus are well adapted to headlamp optics. The enclosed volume of such lamps is roughly that of pea, so the whole lamp may be conveniently formed initially from a small diameter quartz tube. Since the light source itself is small, the reflector optics may be made correspondingly small.

One difficulty that arises is that the lamp must be precisely located within the reflector assembly. Additionally, when ignited, the lamp becomes hot, thereby requiring that support materials for the lamp must be such that they can withstand high temperature operation. Although, because of their ability to withstand high temperatures, metals and ceramics have been used to support arc tubes in the past, these materials are hard, and precise coupling of the arc tube with a metal or ceramic support structure can cause a strain between the arc tube and the support. Since the conventional manufacture of arc tubes and support structures normally results in some variation of the parts, some manufactured lamp tubes will have high contact and stress, whereas others will have low contact and stress. The coupling stress is made worse by thermal expansion and contraction of the components of the lamp as it is turned on and off. Finally, the arc tube can be caused to fracture if a portion of it is pinched in a support structure. Thus, a need exists for an arc discharge headlamp capsule that can withstand the temperatures of operation and still allow the arc discharge tube to be precisely positioned and focussed without applying excessive stress to the tube.

A related problem concerns the energy management of the arc tube. The physics of the arc process are carefully designed for a particular operation temperature. If thermal conduction from the arc tube differs, for example where the support structure has a low or high amount of contact with the arc tube, heat can build up or be lost too quickly from the arc tube. As a result, the physics of the arc change, causing variations in lamp optics, life and color. Thus a need exists for a support structure that offers a consistent thermal contact from one arc tube to the next.

The prior art includes various attempts to overcome some of the problems described above, however, to date, these attempts have been less than ideal. Included among the prior art are the following:

- U.S. Pat. No. 4,734,612 discloses a double-ended lamp capsule having leads welded to support wires. One support wire extends through an insulating sleeve and then, in parallel with the second wire, extends through a seal area of an enclosing capsule.
- U.S. Pat. No. 4,754,373 discloses a double-ended filamented lamp capsule positioned in an automobile headlamp reflector. The reference discloses a structure in which a double-ended capsule may be welded and aligned axially as part of the automobile headlamp.

- U.S. Pat. No. 5,032,758 shows an arc discharge unit axially aligned in a headlamp capsule.
- U.S. Pat. No. 5,036,439 discloses a double-ended arc discharge lamp capsule held in a metal reflector or shield. The reflector includes spring tabs that press against the lamp tube to properly position the shield.
- U.S. Pat. No. 5,039,904 discloses a double-ended arc discharge tube axially mounted in a headlamp. One end of the tube is captured in a threaded structure having O-rings. The forward lead is ducted away from the capsule base to pass through the reflector body for exterior electrical connection.
- U.S. Pat. No. 5,051,658 discloses a double-ended arc discharge tube having one end pinched between two metal arms. The arms are supported on a bush that is in turn connected to a tube and holder body.
- U.S. Pat. No. 5,059,855 discloses a double-ended arc discharge tube welded by its leads at each end. The forward lead extends back through an insulating sleeve to a base. The leads are otherwise ducted through the body of the base.
- U.S. Pat. No. 5,291,092 discloses a double-ended arc discharge headlamp capsule having an arc tube, wedge, retainer, forward connector rod, insulating sleeve, RF-ring, and base. The wedge is formed to mate with an end of the arc tube and to be compressed along its exterior by the retainer. The compressed wedge is said to gently, but firmly, hold the arc discharge tube.

SUMMARY OF THE INVENTION

The present invention relates to an arc discharge headlamp capsule formed from an arc discharge tube having a forward end with a forward lead, a rear end with a rear lead, and a low stress, adaptable coupling. The coupling includes a split ball which holds one end of the arc discharge tube securely, yet allows three dimensional repositioning of the arc discharge assembly to allow the lamp to be properly focused. The ball is retained between a locking nut and a base which allows the ball to be tilted approximately 2° from a center line in any direction and to be rotated about the center line approximately 3° in either the clockwise or counterclockwise direction.

The device is adapted to be assembled using an automated assembly process, if desired, by virtue of snap-fit components. Additionally, the focus capability provided by the split ball allows the lamp to be accurately positioned and focused in a single step.

DETAILED DESCRIPTION OF THE INVENTION

In its broadest form, the lamp capsule is an arc discharge tube that is mounted in a base using a split ball assembly clamped by a co-acting nut. The coacting nut may be considered to be a threaded piece with a concave surface defining a section of a sphere positioned around one end of the lamp. In the split ball assembly, two half balls each define an internal cylindrical passage. The half balls are mated to one end of the tubular lamp. The coacting nut is threaded to a base also having a concave surface defining a section of a sphere, thereby trapping the half balls in place, and pinching them against the arc tube. The arc tube and half balls may be rotated with reference to the threaded piece and the base to thereby locate the light source properly. Similarly, the arc discharge tube may be slid in or out of the half balls before being fully compressed to provide axial extension during focusing of the light source.

Figure 1:
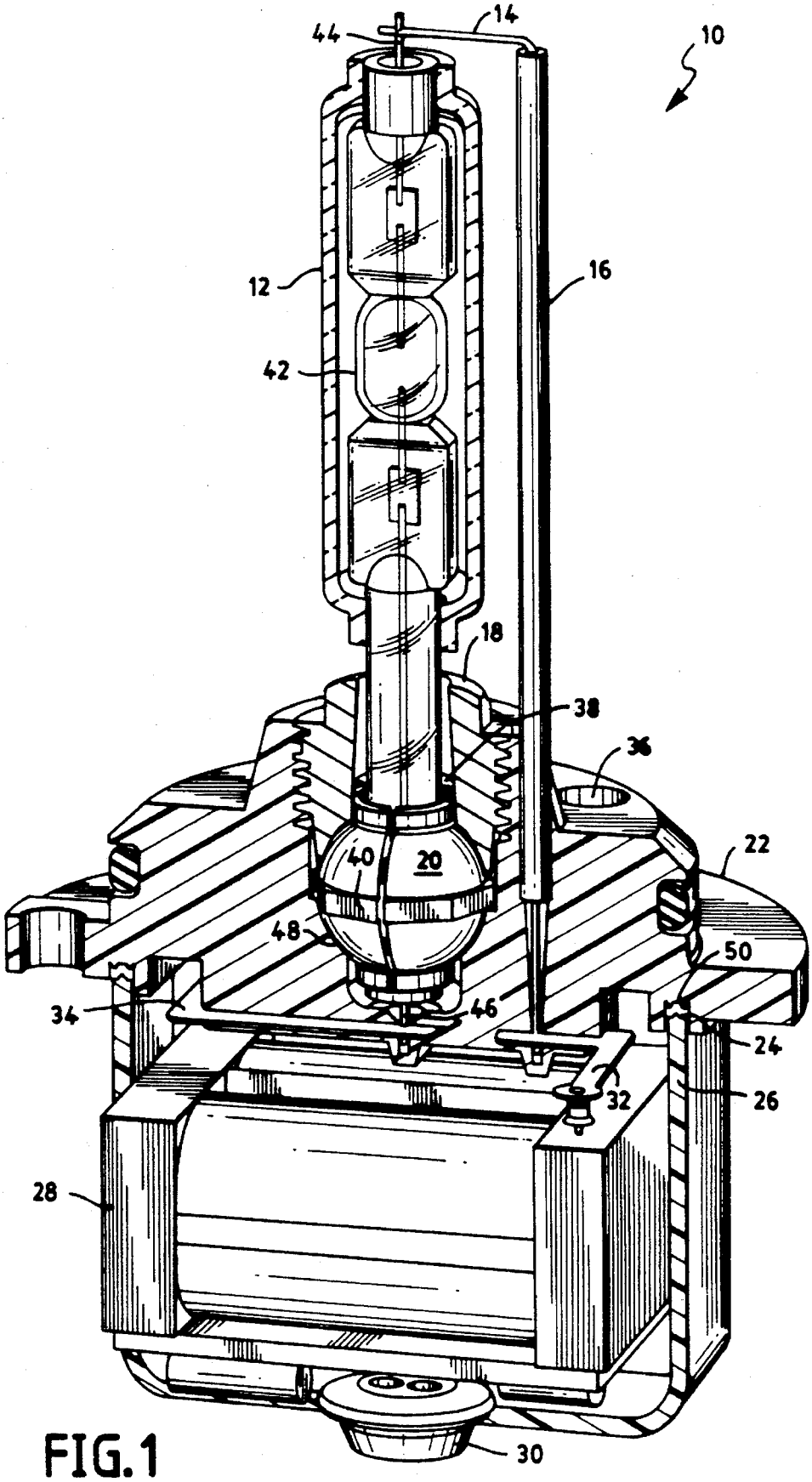
FIG. 1 is an isometric cross-section of one embodiment of the headlamp assembly.

FIG. 1 shows one preferred embodiment of an arc discharge headlamp capsule 10. The arc discharge headlamp capsule may be assembled from a double ended, jacketed arc tube 12, a lead wire 14, a ceramic sleeve 16, a locking nut 18, a split ball assembly 20, a base 22, a die cut gasket 24, a back cover 26, an igniter assembly 28, a rubber grommet 30, a short contact 32, a long contact 34, and an O-ring seal 38. The split ball assembly 20 may be provided with a hex pattern 40 which serves to limit the rotation of the split ball assembly 20 within the base 22. Additionally, the base may include at least one aperture 36 which allows the assembly to be filled, in whole, or in part, with a potting compound.

The double ended arc tube 12 may be formed from a quartz tube to include an arc discharge envelope 42 electrically supplied at a forward end (top in FIG. 1) through a forward lead 44 and a rear lead 46 at its rear end (bottom in FIG. 1). The preferred arc tube 12 is a cylindrical quartz tube with a closed arc discharge envelope 42 formed along a middle region of the tube. The arc discharge envelope 42 may vary in size and shape, but examples are known to include an enclosed volume of about 0.20 to about 0.50 milliliters. Extending forward along the axis of the arc tube 12, the forward lead 44 is typically pressed or vacuum sealed to the quartz tubing. Extending rearward along the axis of the arc tube 12, rear lead 46 is sealed in a similar manner. By way of example, arc tube 12 is shown as a cylindrical, double ended, press-sealed arc tube with an approximately elliptical arc discharge envelope. Most other double ended configurations may be used as well.

The use of the split ball assembly 20 allows the arc discharge tube 12 to be mounted to the base 22, back cover 26 and igniter 28 assembly easily and in a manner in which its position may be easily adjusted in a single step process for properly positioning the arc discharge envelope 42 relative to a reflector (not shown).

The basic assembly procedure is preferably an automated, high-speed process which may be carried out as follows. First, the split ball assembly 20 is inserted into a concave depression 48 located generally at the center of the base 22. A locking nut 18 having a central bore with an O-ring seal 38 already inserted into it from the bottom is screwed down into the base until it just contacts the split ball assembly 20 without applying any significant force onto the assembly. Next, the jacketed arc tube 12 is inserted through the bore of the locking nut 18, the O-ring seal 38 and the split ball assembly 20. At this point, a long contact 34 is inserted into the base 22 until it snaps around the rear lead wire 46 coming out of the rear of the jacketed arc tube 12. This connection is referred to herein as a press-fit connection.

The assembly is then focused by engaging the locking nut 18 while simultaneously engaging the top of the jacketed arc tube 12 to allow rotational and axial movement of the tube 12 within the base 22. Engagement of the locking nut 18 and the top of the arc tube 12 can be carried out using either automatic or manual equipment. At the same time, electrical contacts engage the forward lead wire 44 extending from the top of the arc tube and long contact 34 which has previously been electrically connected to the rear contact 48 extending from the rear of the arc tube. At this point, the electrical contacts are energized causing the envelope 42 to light. The arc tube 12 can be maneuvered, either automatically or manually, in each of the X, Y, and Z axes until it is positioned at a desired location, i.e., the focal point for the headlamp assembly. Once the envelope 42 is positioned at a desired location, the locking nut 18 is tightened to a predetermined torque, thereby squeezing and locking the split ball assembly 20 snugly and firmly around the bottom of the arc tube 12. The split in the ball assembly 20 serves to accommodate all variations and tolerances of the arc tube, the base 22 and the locking nut 18.

Once the arc tube is locked into position at a desired location, a lead wire 14 is inserted into a ceramic sleeve 16 which is then inserted into the base 22. The lead wire 14 is welded to the forward lead 44 so as to make electrical contact with the forward end of the arc discharge tube. A short contact 32 is then extended into the base 22 until it snaps around the bottom end of the lead wire 14. Finally, a gasket 24 such as a die cut resilient polymer is inserted into a rectangular trough 50 on the bottom of the base 22, and a rear cover 26 is snap-fit into place. In one embodiment, the top of the cover 26 and the inside of the trough 50 include raised protrusions which interface with the gasket 24 and assure a positive seal when assembled.

If desired, the cover 26, igniter assembly 28, grommet 10 are pre-potted with a potting compound to fill the majority of the volume of the base 26 interior not occupied by the igniter 28. Once the top assembly (with the mounted arc tube attached) and the partially potted bottom assembly are snap-fit together, the entire assembly can be topped off with additional potting compound through at least one aperture 36. In so doing, the assembly becomes completely sealed and all electrical contacts become insulated.

Figure 2:
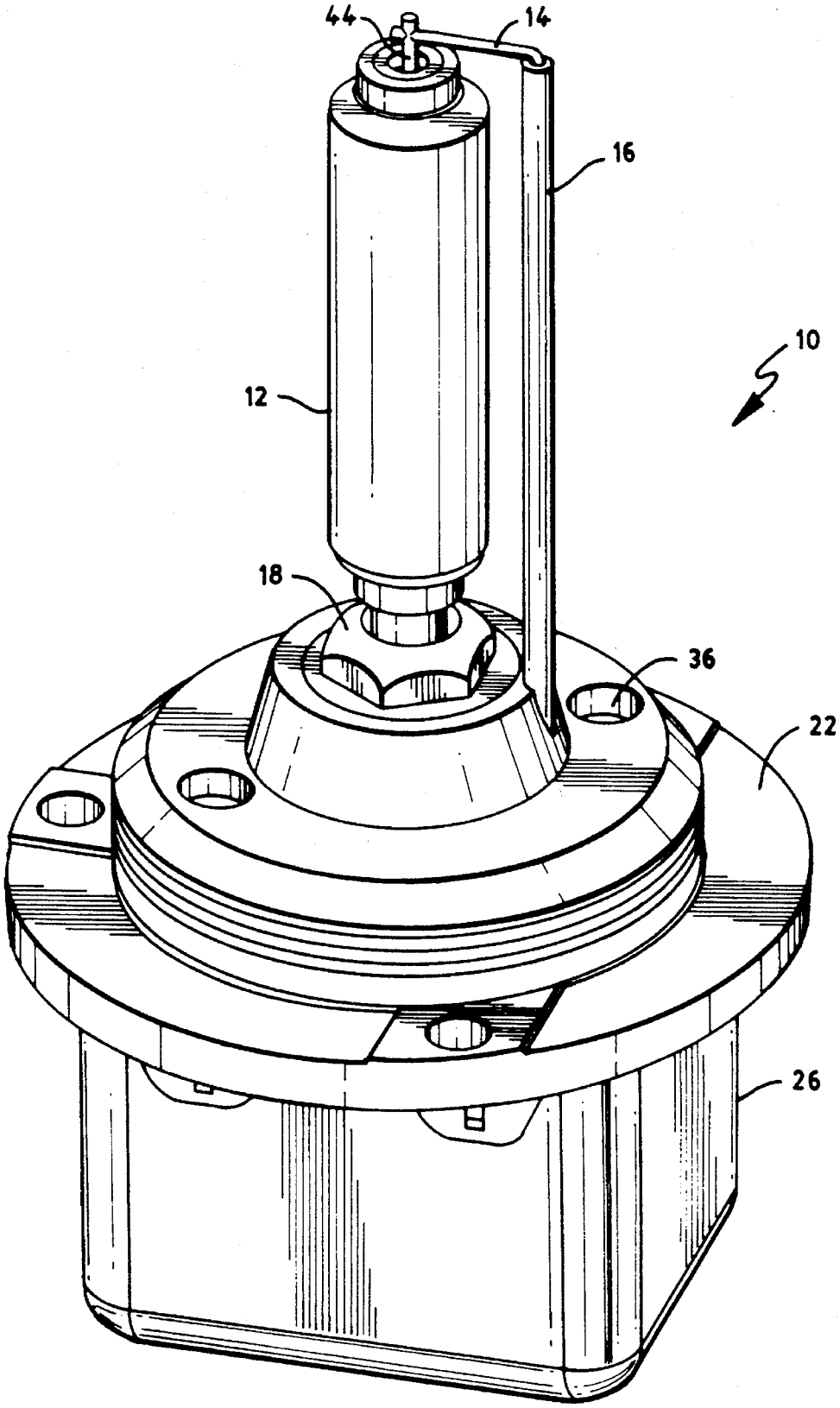
FIG. 2 is an isometric top view of the HID lamp assembly.
Figure 3:
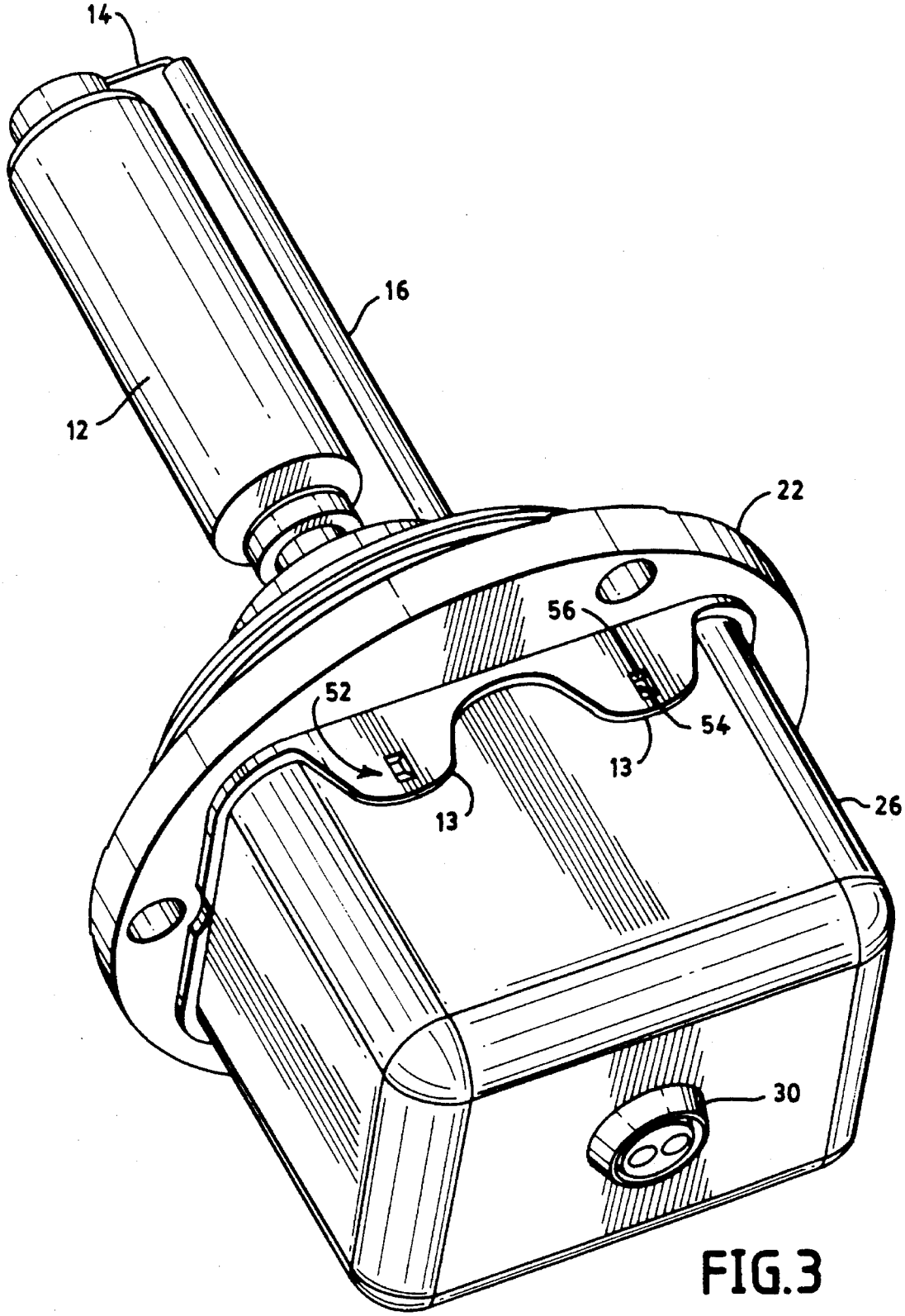
FIG. 3 is an isometric bottom view of the HID lamp assembly.

An isometric view of the completed assembly, without the cut-away of FIG. 1, is shown in FIG. 2. Likewise, FIG. 3 is an isometric bottom view of the lamp assembly 10 showing the base 26 and cover assembly 22 engaged by snap-fit connections 52. In particular, the base 26 includes a number of protrusions 54 which engage apertures 56 formed in flanges 58 extending from the bottom of the base 22. Thus, when the cover 26 is pressed against the bottom of the base 22, the protrusions 54 on the cover 26 are caused to engage the apertures 56, effectively locking the cover to the base.

Figure 4:
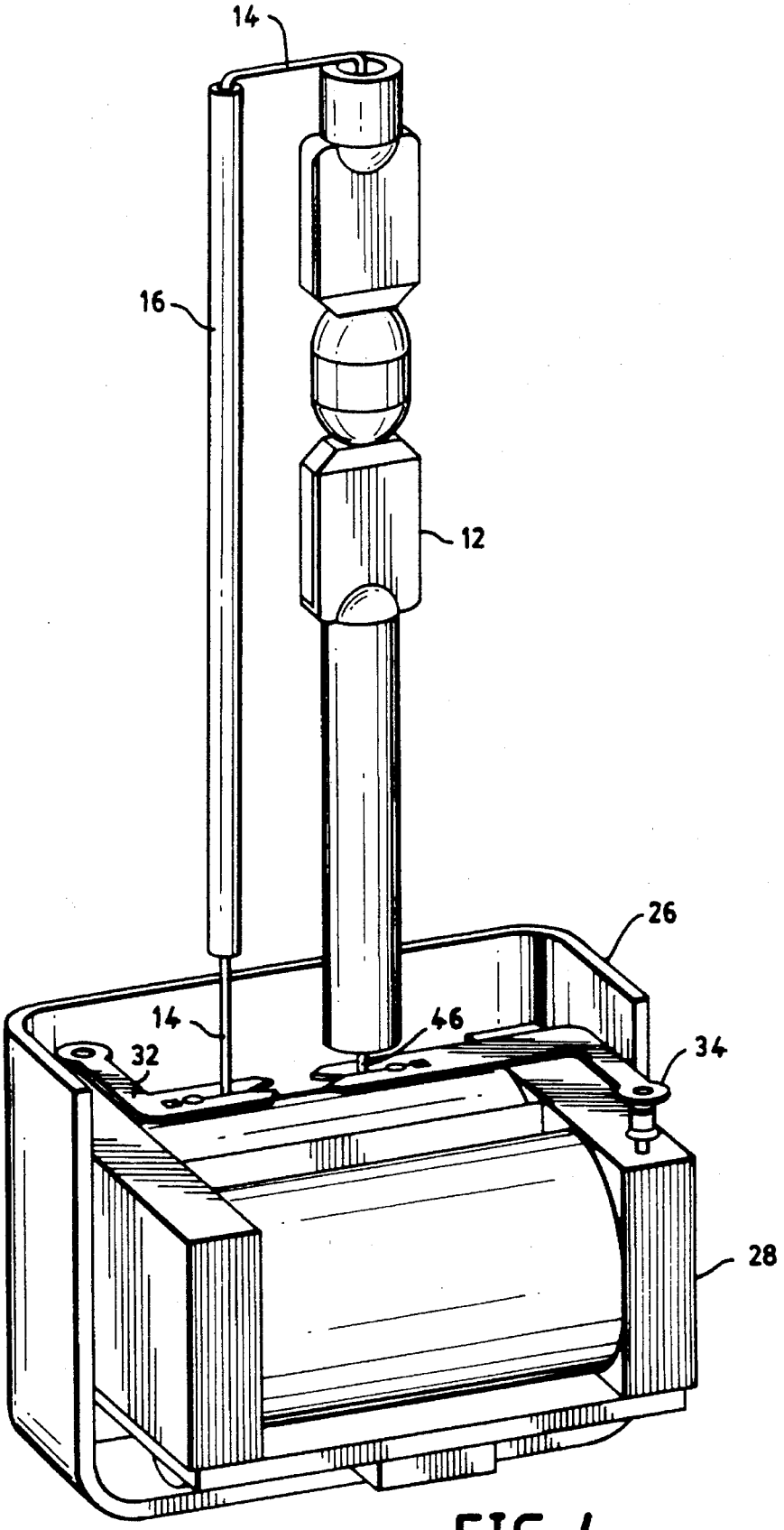
FIG. 4 is an isometric top cross-section of the HID lamp assembly showing electrical contact.

FIG. 4 is an isometric top cross-section in which the base, O-ring seal, locking nut, and split ball assemblies are not shown. FIG. 4 shows the manner in which the short 32 and long 34 contacts engage the lead wire 14 and the rear lead wire 46, respectively. In addition, the figure shows the relationship between each of the short and long contacts 32, 34 with the igniter 28.

Figure 5A:
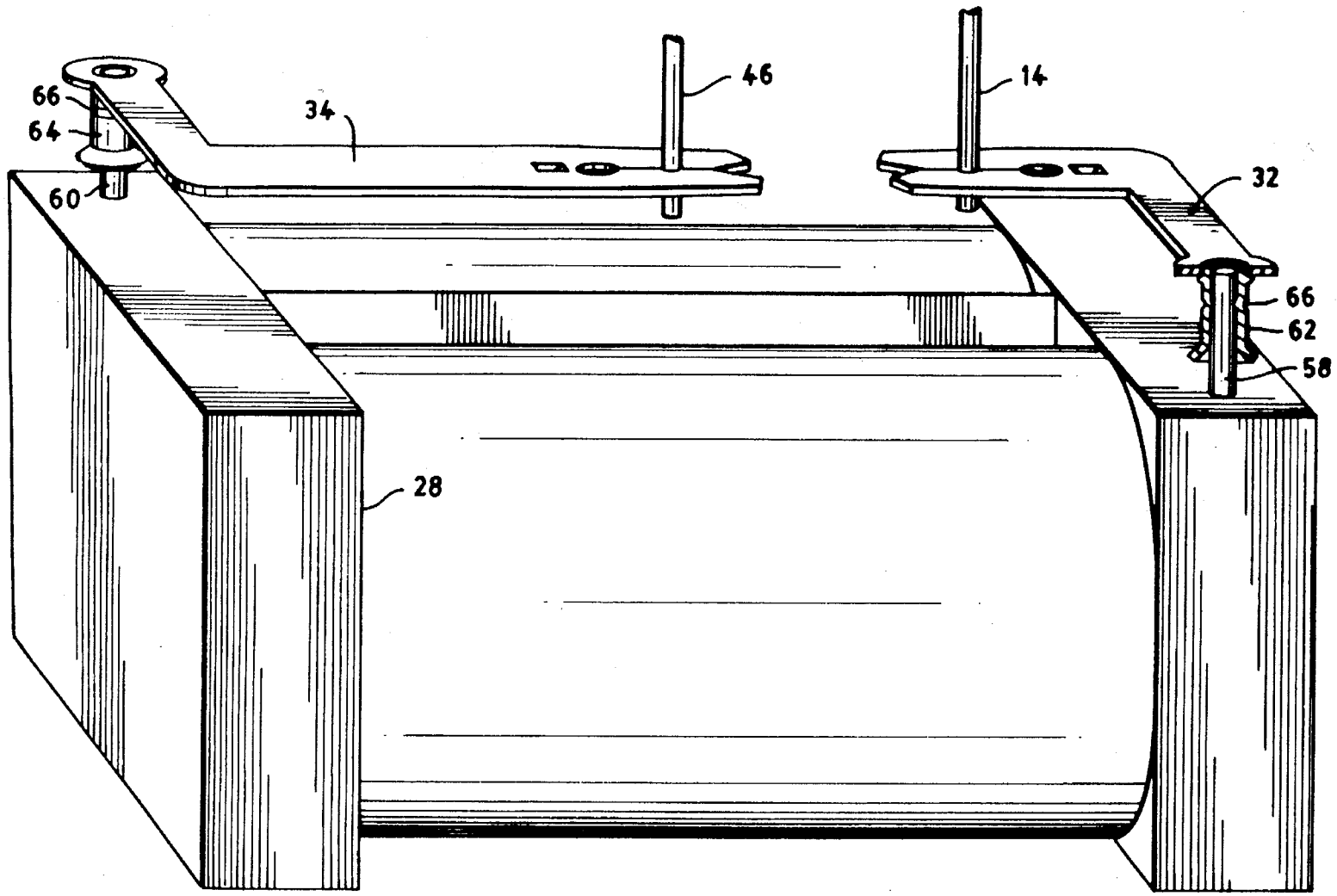
FIG. 5A is an isometric top cross-section of an HID lamp assembly showing an enlarged view of the interface between the electrical contacts of the arc discharge tube and the lamp base.

FIG. 5A is an isometric top cross-section showing an enlarged view of the interface between the lead wire 14 with the short contact 32, the rear lead 46 with the long contact 34, and the interface between each of the short 32 and long 34 contacts with the igniter 28. In particular, FIG. 5A shows how wires 58, 60 extending from the igniter 28 are electrically connected to the short 32 and long 34 contacts respectively. As may be seen, each of the long 34 and short 32 contacts includes a connector sleeve 62, 64, respectively having a pinched or necked down area 66 which engages each pin 58, 60 and makes electrical contact therewith. Each of the pinched areas 66 provides its respective sleeve 62, 64 with an internal diameter slightly smaller than the diameter of contact wires 58 and 60, thus allowing the sleeves 62 and 64 to make good electrical contact with the wires 58 and 60 when the wires are pressed through each sleeve.

Figure 5B:
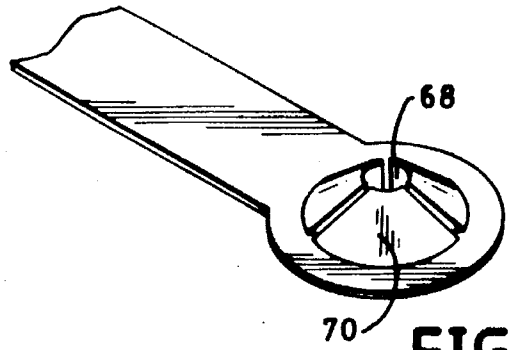
FIG. 5B is an isometric top view of a second embodiment of a contact interface.

FIG. 5B shows an alternate way of making the electrical interface between the short 32 and long 34 contacts and the wires 58 and 60. In FIG. 5B, each contact has an aperture 68 having fingers 70 which spread apart as they are pushed down over a wire 58, 60 extending from the igniter 28. The fingers 70 engage the wires 58, 60 in a manner which provides desired electrical contact. In each of FIGS. 5A and 5B, the connection between each contact and its corresponding wire may be considered to be a press-fit connection.

Figure 6:
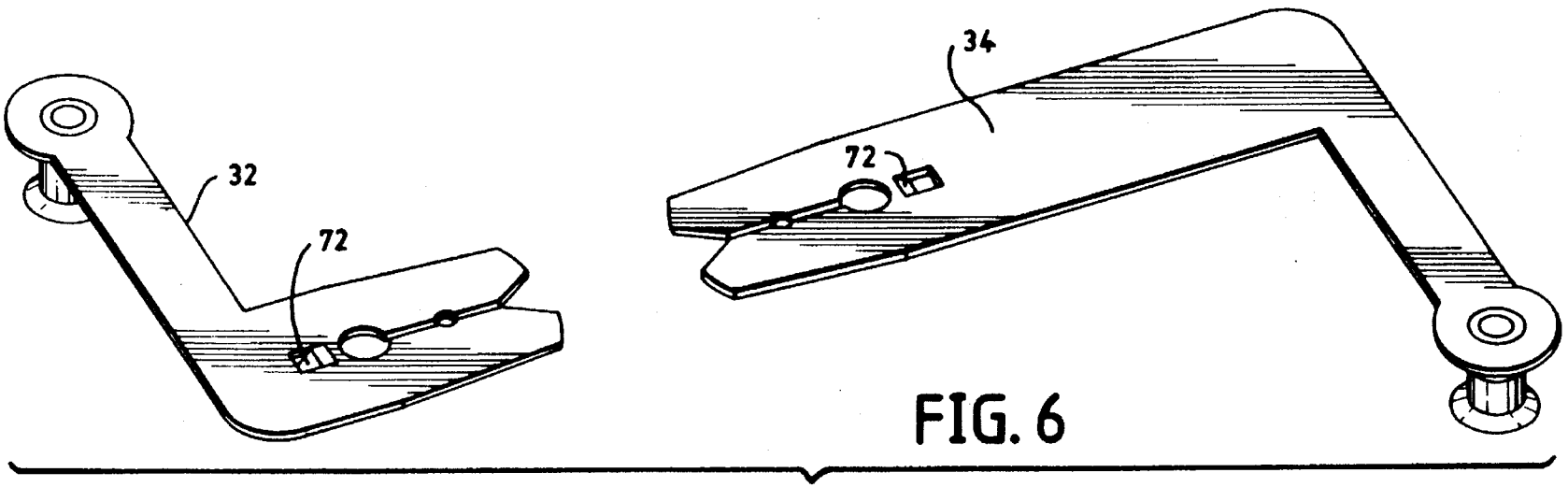
FIG. 6 is an isometric view of the HID lamp contacts.

FIG. 6 is an isometric view of short 32 and long 34 contacts. As can be seen, each contact includes a barb 72 formed within each contact. The barbs are configured to engage the plastic material of the base 22, thereby lessening the possibility that the electrical circuit of the lamp assembly may be broken as a result of undesired movement of the contacts. In particular, the barbs 72 are intended to maintain the contacts 32, 34 in electrical communication with the lamp assembly even during periods when the lamp is subjected to strong vibration.

Figure 7A:
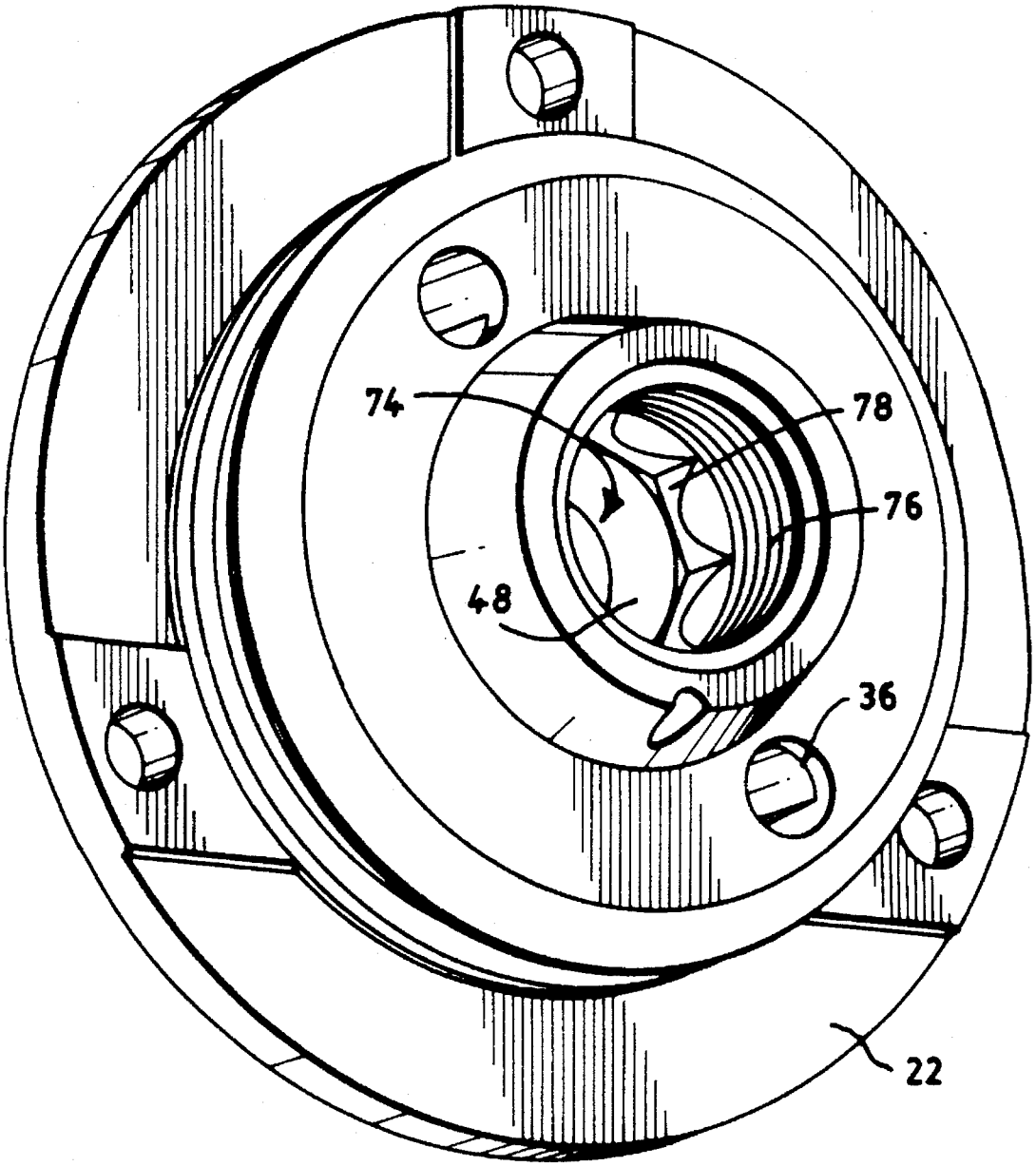
FIGS. 7A and 7B are isometric views of the HID lamp base.
Figure 7B:
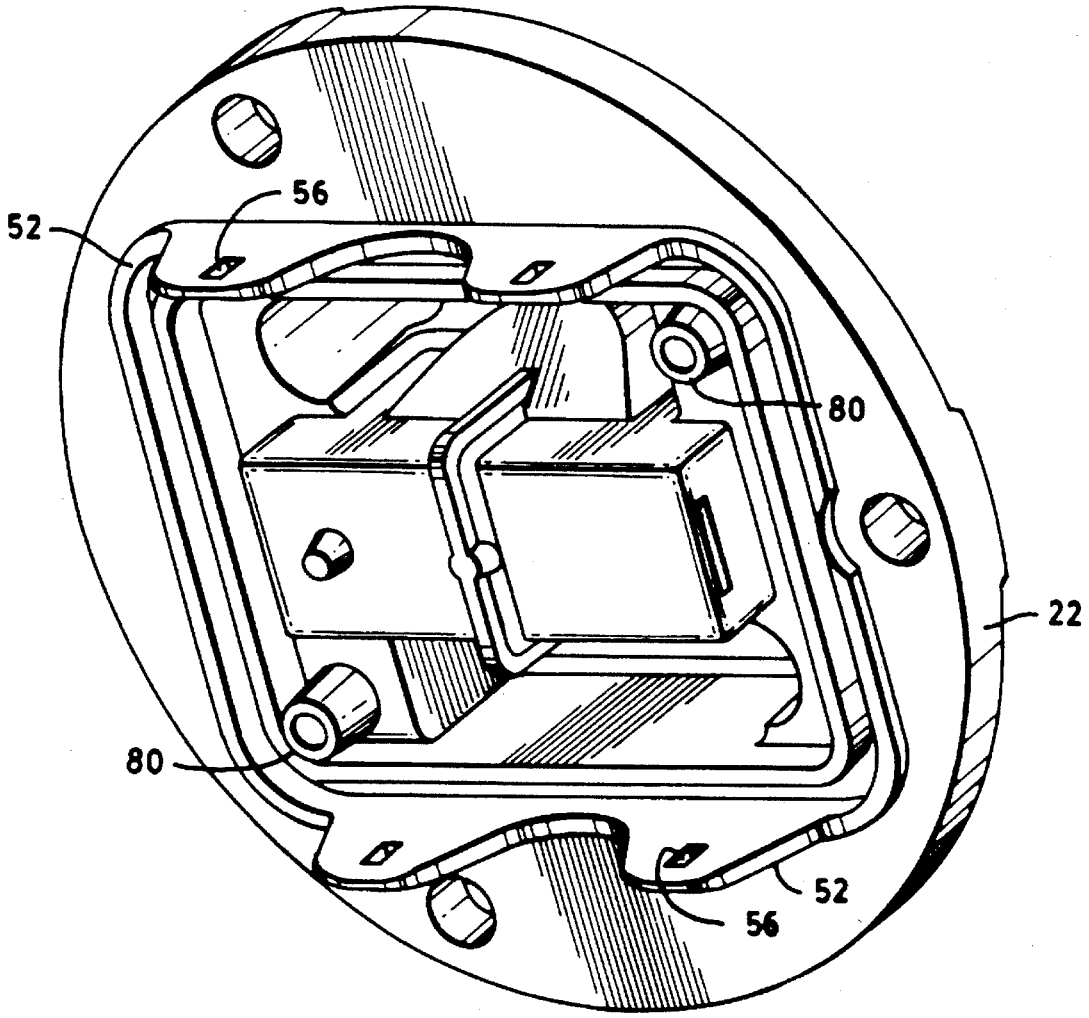

FIGS. 7A and 7B are two isometric views of the base 22. FIG. 7A is a top view of base 22 showing a central aperture 74 that is molded to include a concave depression 48, a threaded portion 76 which engages threads on locking nut 18, and a hex pattern area 78 intended to engage the hex portion 40 of the split ball assembly 20. The hex pattern area 78 also serves as an interface between the concave depression 48 and the threaded portion 76 of aperture 74. The hex pattern area 78 of the base 22 is somewhat larger than the hex portion 40 on the split ball assembly 20. Thus, when the split ball assembly is positioned within the base, the hex portion 40 of the split ball assembly 20 is allowed limited freedom of movement before it interferes with the hex pattern area 78 of the base. The interplay between the hex pattern area and the hex portion of the split ball assembly thus allows the split ball assembly (and correspondingly, the arc discharge tube 12) to be rotated and tilted to a degree necessary to allow the lamp to be focused, while at the same time limiting the amount of rotation that could adversely affect lamp performance. Further details of the interplay between the hex pattern area 78 and the hex portion 40 are described below with respect to FIG. 11. FIG. 7A also shows two potting holes 36, through which a potting compound may be injected into the interior of the completed lamp assembly.

Figure 8:
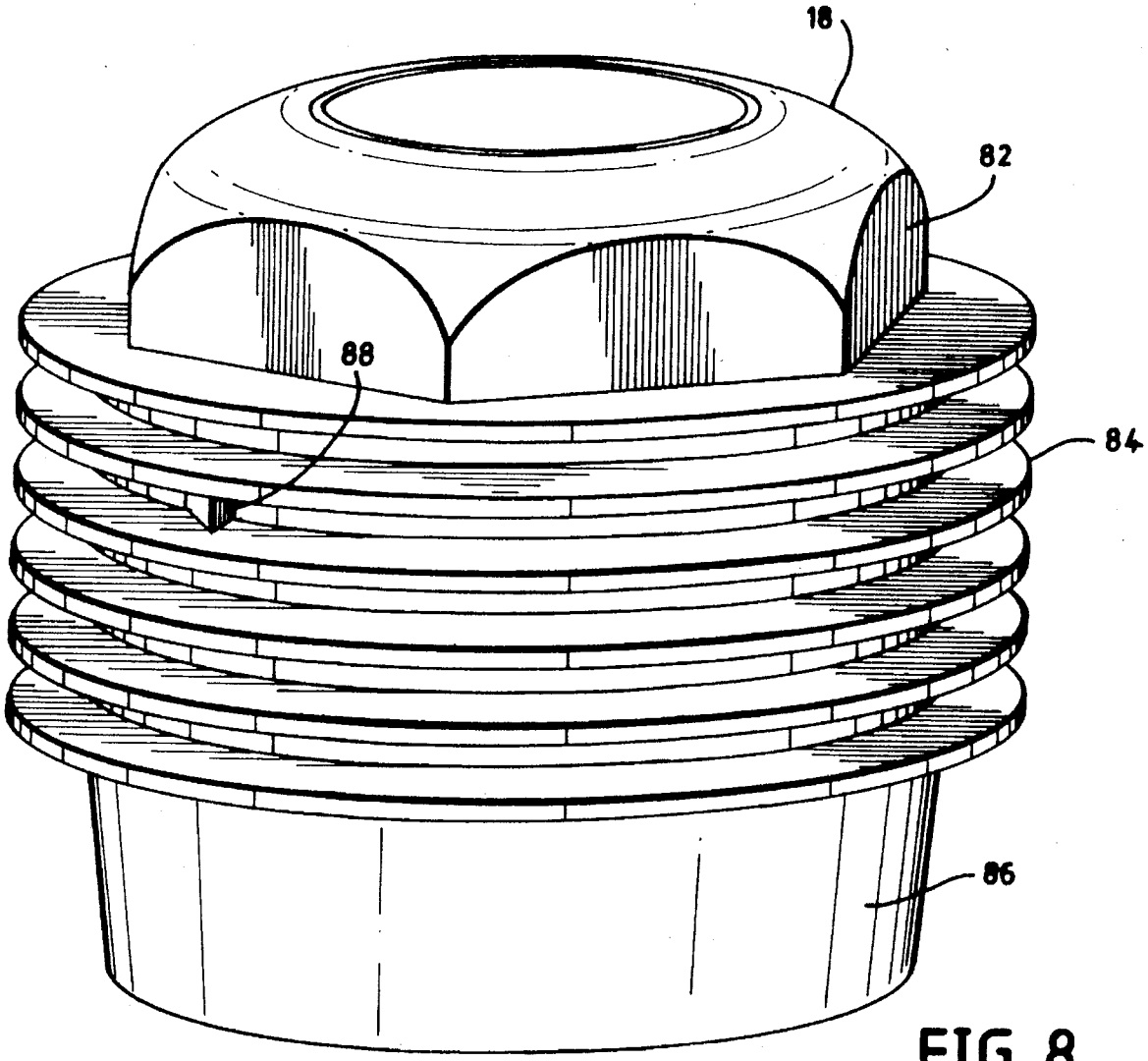
FIG. 8 is an isometric view of a locking nut for use with the present invention.

FIG. 7B is a bottom view of the base 22 showing the flanges 52 and apertures 56 which engage protrusions on the cover to lock the cover to the lamp base as described in connection with FIG. 3. As shown in FIG. 7B, the base may also include back-up supports 80 which engage the ends of contacts 32 and 34 in the area in which those contacts mate with wires 58 and 60 extending from the igniter 28. As such, the back-up supports 80 prevent the contacts from becoming disengaged from the contact wires on the igniter and breaking the electrical circuit. Each back-up support includes a central opening which allows for variations in the length of the igniter contact wires if they project through their respective contacts. FIG. 8 is an isometric view of the locking nut 18. The nut 18 includes a tool engagable portion 82 such as a hex configuration which allows the nut 18 to be engaged by either a manual or automatic tool and rotated in both the clockwise and counterclockwise directions. The nut further includes threads 84 intended to engage and mate with the threads 76 on the base 22. Thus, the nut 18 can be advanced and retracted relative to the base, via rotation, during the focusing adjustment process. Nut 18 also includes a ball-retaining portion 86 having a concave interior (not shown) for engaging the upper half of the split ball assembly 20 as shown in FIG. 1. Optionally, nut 18 may be provided with anti-backout barbs 88 which interfere with the threads 76 on base 22 and inhibit the nut 18 from being rotated in the counterclockwise (loosened) position. Preferably two barbs 88 each spaced approximately 180° apart are provided, however, other configurations are possible as well. Furthermore, an adhesive or other motion inhibiting material may be applied to the threads 84, either alone or in combination with the optional barbs, to further inhibit the loosening of the nut 18. Inhibition of loosening is desired, since, if the nut 18 is loose, the focus position of the arc discharge tube 12 may be lost. Thus, it desirable that the nut, once the lamp has been focused, maintains its position even in high vibration environments.

Figure 9:
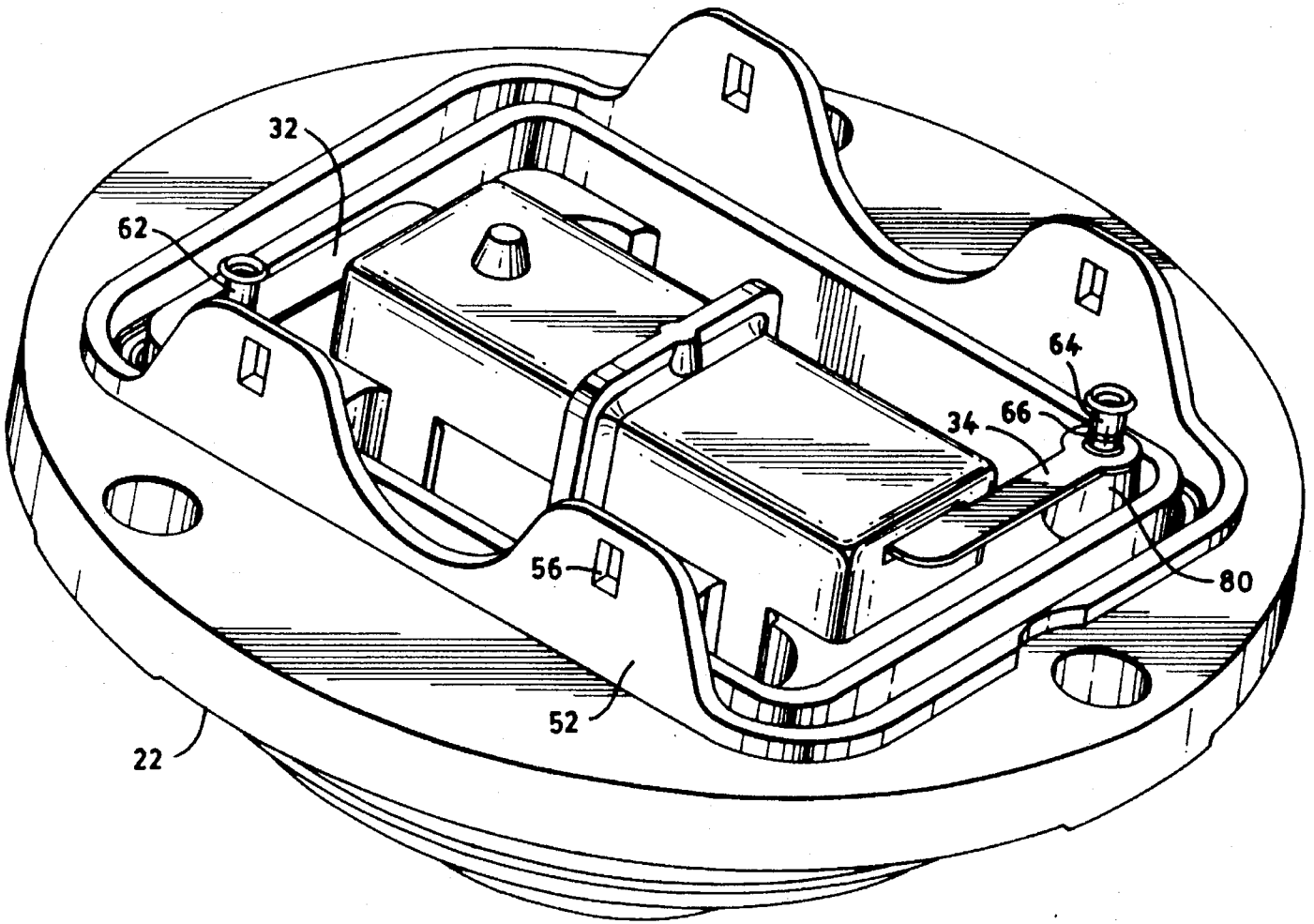
FIG. 9 is an isometric view of the bottom of the base used in connection with the present invention.

FIG. 9 is an isometric view of the bottom of base 22 showing the contacts 32 and 34 pressed into place against support 80.

Figure 10:
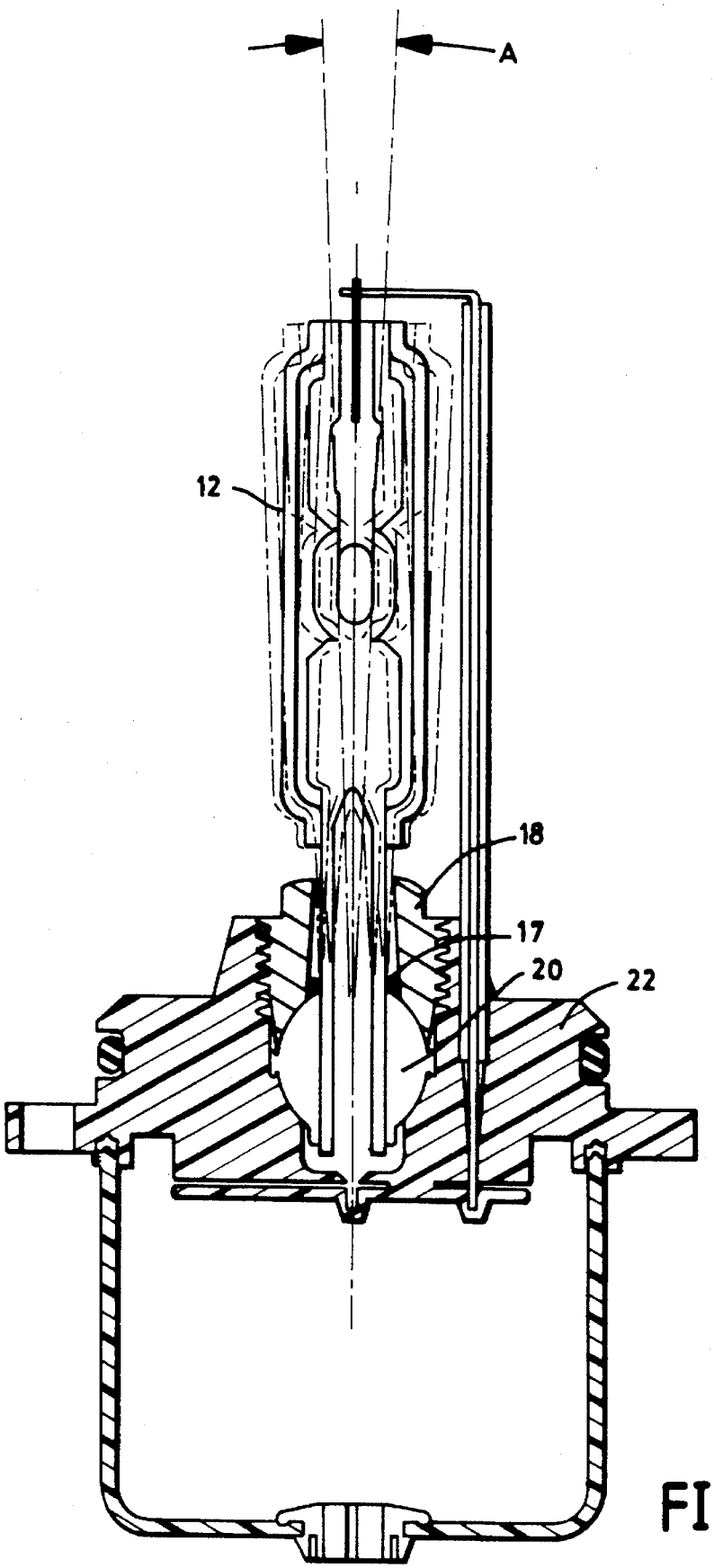
FIG. 10 is a cross-section showing the focusing capability of the lamp of the present invention.

FIG. 10 is a cross-section showing the manner in which the arc discharge tube may be tilted, via the spit ball assembly 20 in order to properly position the lamp for focusing. The figure shows how the structure provides the lamp with a limited degree of freedom prior to focussing. Angle A represents, in one preferred embodiment, tilting the lamp to a limited degree such as, for example about 4°. In accordance with the assembly method described, once the lamp is positioned at a desired location, the locking nut 18 is tightened to firmly engage the split ball assembly 20 and firmly hold the arc tube 12 at that focus position.

Figure 11:
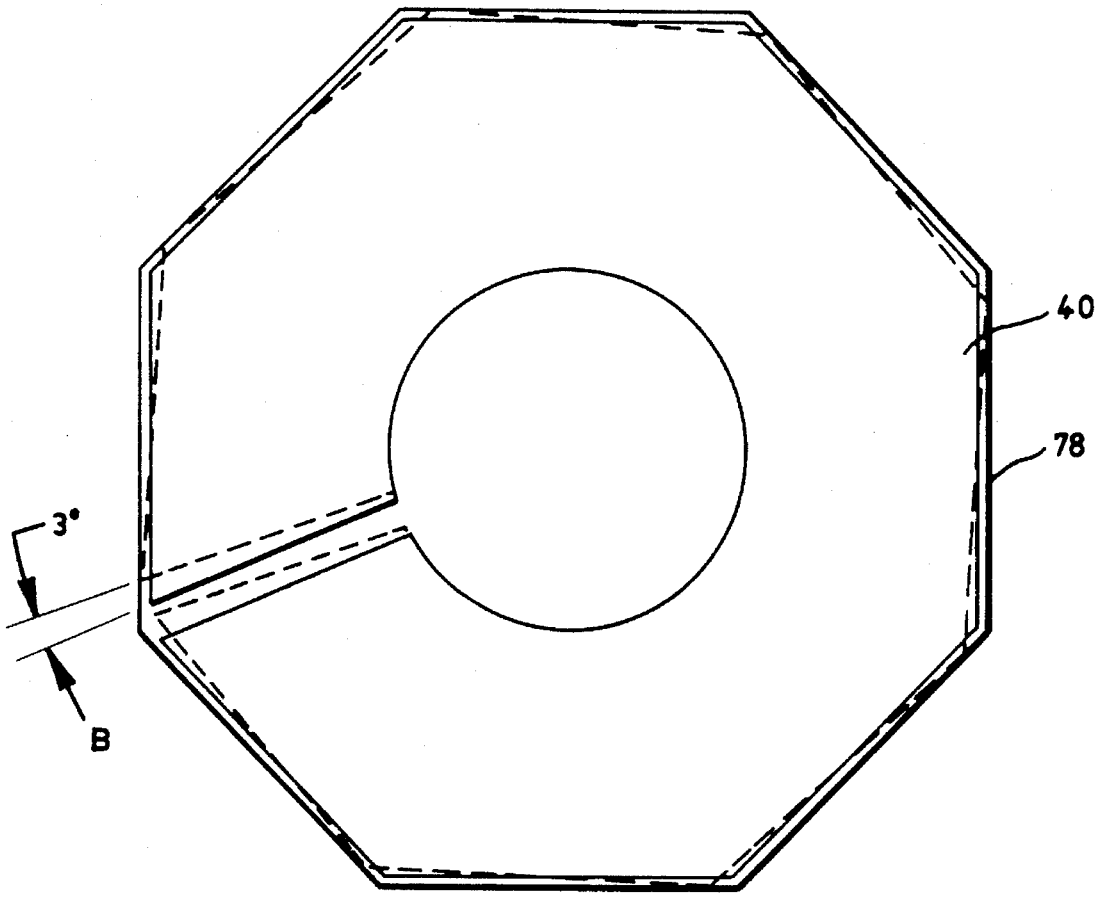
FIG. 11 is cross-section of both the base hex pattern and the split ball hex pattern of the present invention.

FIG. 11 is a cross-section showing the interaction between the hex patterned area 78 of the base and the hex portion 40 of the split ball assembly. As may be seen in FIG. 11, the hex portion 40 of the split ball assembly is free to move by rotation a limited amount within the hex pattern area 78. In the preferred embodiment, the hex portion 40 is allowed to rotate about a limited angle B which in a preferred embodiment represents a rotation of approximately ±3° from the center line.

The individual components of the lamp assembly may be fabricated using various materials known to those of ordinary skill in the art. For example, the base, back cover, split ball assembly, and nut 18 may be formed of various polymers that are known to withstand the strength and temperature requirements of automobile headlamps and the like. Likewise, such polymeric components may be formed using any of a wide variety of techniques known in the art. In one preferred embodiment, the base and cover are made of a glass-filled polysulfone (Mindel) plastic and the split ball assembly is formed of a slightly flexible, high temperature resistant material, such as a glass-filled polyamide-nylon plastic.

Equivalents

Having thus described a few particular embodiments of the invention, various alterations, modifications and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A lamp assembly comprising:

a) a light source with a tubular end;

b) a threaded nut having an axis, an exterior thread region, an internal surface defining a passage, and a concave surface extending around the axis at an end of the passage, defining a section of a sphere, the threaded nut being positioned around the tubular end of the light source;

c) a split ball assembly comprising first and second half balls each having similar exterior surfaces defining sections of a sphere, conformal with the spherical section of the threaded nut, the first and second half balls each having similar internal surfaces defining a surface conformal with the tubular end of the light source, the first and second half balls being positioned around the tubular end of the light source adjacent to the concave section of the nut;

d) a base having an axis and an aperture defining a thread section extending around the axis and a section of a sphere conformal with the split ball assembly; and electrical connections for the light source;

wherein the threaded nut is threaded to the base to engage the split ball assembly and trap the light source in place with respect to the base.

2. The lamp assembly of claim 1, wherein internal surfaces of the first half ball and second half ball in combination define a tubular cavity extending diametrically with respect to the spherical surface defined by the exterior surfaces of the first and second half balls.

3. The lamp assembly of claim 1, wherein a lead extends from the light source through the tubular end, between the first and second half balls into the base for electrical connection.

4. The lamp assembly of claim 1, wherein the threaded nut, in a first position allows rotational and axial adjustment of the light source relative to the base, and in a second position prevents movement of the light source relative to the base.

5. The lamp assembly of claim 4, wherein the threaded nut includes means for maintaining the nut in the second position.

6. The lamp assembly of claim 1, which further includes an end cap mated to the base.

7. The lamp assembly of claim 6, wherein the end cap is mated to the base via a snap-fit connection.

8. The lamp assembly of claim 1, wherein the electrical connections for the light source include at least one contact having a press-fit connection.

9. The lamp assembly of claim 1, wherein at least one of the split ball assembly and base includes a portion for limiting rotation of the light source relative to the base.

10. The lamp assembly of claim 1, wherein at least one of the split ball assembly and base includes a portion for limiting tilting of the light source relative to the base.

11. The lamp assembly of claim 1, wherein at least one of the split ball assembly and base includes a portion for limiting rotation and tilting of the light relative to the base.

12. The lamp assembly of any of claims 9, wherein the split ball assembly includes a hex portion corresponding to a hex pattern area within the aperture of the base.

13. The lamp assembly of any of claim 10, wherein the split ball assembly includes a hex portion corresponding to a hex pattern area within the aperture of the base.

14. The lamp assembly of any of claim 11, wherein the split ball assembly includes a hex portion corresponding to a hex pattern area within the aperture of the base.

15. The lamp assembly of claim 1 which further includes an igniter.

16. The lamp assembly of claim 13, wherein the igniter is in electrical communication with the arc discharge tube via at least one press-fit connection.

17. The lamp assembly of claim 13, wherein the igniter is mounted in the end cap and surrounded by a potting compound.

* * * * *